United States Patent [19]

Jackson

[11] 4,395,818

[45] Aug. 2, 1983

[54] BLOCK LOADER

[75] Inventor: Mark F. Jackson, Harrisburg, Pa.

[73] Assignee: AMP Incorporated, Harrisburg, Pa.

[21] Appl. No.: 244,418

[22] Filed: Mar. 16, 1981

[51] Int. Cl.[3] ..... H01R 43/00

[52] U.S. Cl. ..... 29/747; 29/759; 29/760

[58] Field of Search ..... 29/747–754, 29/759, 760, 564.1, 564.4, 564.6

[56] References Cited

U.S. PATENT DOCUMENTS

| | | | |
|---|---|---|---|
| 3,875,636 | 4/1975 | Shultz, Jr. | 29/747 X |
| 3,891,013 | 6/1975 | Folk et al. | 29/749 X |
| 4,175,316 | 11/1979 | Gudmestad | 29/564.4 |
| 4,235,015 | 11/1980 | Funcik et al. | 29/749 X |
| 4,247,980 | 2/1981 | Tominoi | 29/742 |
| 4,308,660 | 1/1982 | Brown et al. | 29/759 X |
| 4,335,497 | 6/1982 | Casey | 29/753 X |

*Primary Examiner*—Carl E. Hall

*Attorney, Agent, or Firm*—F. Brice Faller

[57] ABSTRACT

Apparatus and method for mass loading of terminated leads, carried laterally by gripping means on a conveyor, into a single row connector housing. Leads are all gripped a like distance remote from terminated ends, which are carried between guide plates into apparatus. Conveyor pauses while leads are aligned into grooves in a template then captured therein as combs align and capture all but the tips of the terminated ends. A connector housing is then moved onto the terminated ends by a carriage as the combs retract, the gripping means and grooves preventing displacement of leads as insertion force is overcome by the advancing carriage. All mechanical movements other than conveyor are effected by rotation of a single cam shaft.

3 Claims, 13 Drawing Figures

BLOCK LOADER

BACKGROUND OF THE INVENTION

The present invention relates to harness assembly machines, and particularly to the loading of a plurality of terminated leads en masse into a single row connector block.

Lead making machines are well known in the prior art, cf. U.S. Pat. Nos. 3,019,679 and 3,686,752. The latter discloses a machine having a pair of parallel conveyors having grippers thereon which grip both ends of the leads and carry them through terminal applicators. U.S. Pat. No. 4,164,808 discloses an apparatus which utilizes parallel conveyors to carry planar sets of wires laterally of their axes through terminal applicators. It would be advantageous, in a machine of this type, to provide an additional station adjacent to either conveyor where the terminated sets of leads could be loaded into a connector block to facilitate manufacture of a wiring harness.

Harness making machines comprise apparatus having the capability to place connector blocks onto wire leads. U.S. Pat. No. 4,055,889 discloses an apparatus which transports leads through a termination station and then to an insertion station where the terminated leads are inserted into a connector housing at the insertion station. Leads are inserted into the housing one at a time by wire grippers while the housing is indexed by an indexing assembly which also transports the housing to and from the insertion station.

U.S. Pat. Nos. 4,043,017, 4,043,034, 4,136,440, and 4,235,015 disclose harness making apparatus directed to the mass loading of wire leads into insulation displacing type connector blocks. These apparatus do not involve terminating the leads prior to insertion.

There is a need in the harness making arts for a connector block loading apparatus which mass loads terminated leads into a connector block, particularly for a block loader suitable for use adjacent a lateral lead transporting conveyor of the type disclosed in U.S. Pat. No. 4,164,808.

SUMMARY OF THE INVENTION

The present invention is directed to apparatus for mass loading of terminated leads into a connector block having a single row of terminal receiving cavities. It is suitable for use adjacent a conveyor which also passes a cutting and stripping station and a terminating station, particularly a terminating station of the type disclosed in U.S. Pat. No. 4,363,167. There the wires are fed axially for mass termination, but the method of spreading and compensating the leads to maintain the leading ends in a linear array for mass termination is equally applicable to a lateral wire feed. The leads may be transported laterally through a termination station where they are mass terminated to terminals at one spacing then transported laterally to an insertion station where they are mass loaded into cavities in a connector housing at a second spacing. Thus, while some of the principles of the present invention could be useful for axially fed leads, they are especially suitable for laterally fed leads. This is accomplished by aligning the terminals close to the terminated ends while capturing the leads to prevent buckling between the ends and the gripping means of a lateral conveyor, then advancing a connector block onto the terminals while withdrawing the means for aligning the terminals.

It is an object of the present invention to provide a block loader for laterally conveyed leads, particularly a loader suitable for use in a fully automated harness making apparatus employing a conveyor having wire gripping means.

It is a related object of the present invention to mass load the terminated leads into a connector housing by holding and radially aligning the terminated ends of the leads at a point remote from gripping means on a conveyor, and moving a connector block onto the ends without moving the leads.

These and other features of the invention will be apparent to one skilled in the art upon reference to the drawings and description which follow.

DETAILED DESCRIPTION OF THE PREFERRED EMBODIMENT

Figure 1:
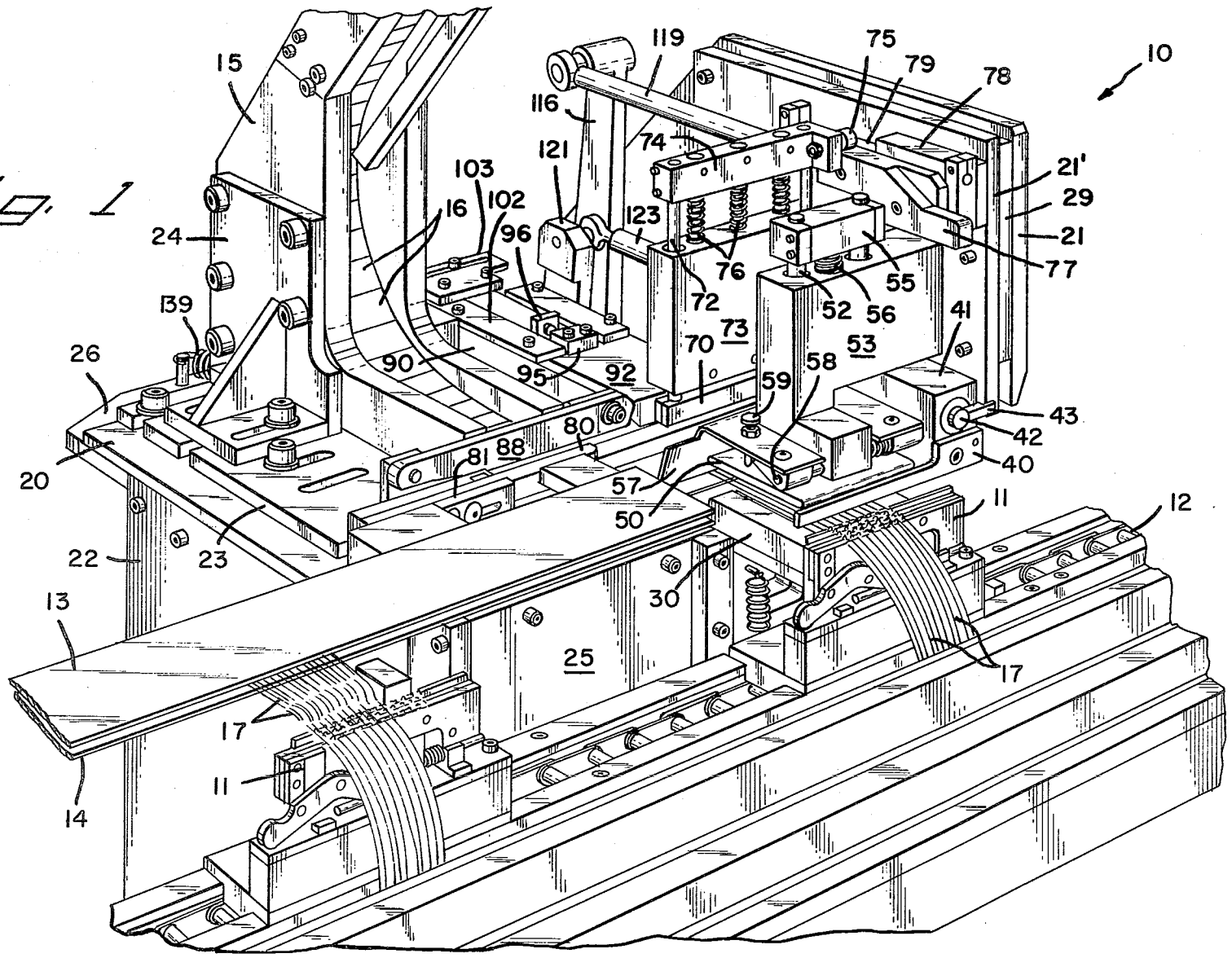
FIG. 1 is a perspective of the apparatus.

FIG. 1 is a perspective of the block loader 10 and wire gripping means in the form of traveling wire clamps 11 which are carried in front of the loader 10 by chain conveyor 12. The leads are loaded into the clamps 11 upstream of the block loader so that the ends are all equidistant from the clamps, and are then transported so that the ends lie between upper guide plate 13 and lower guide plate 14. This prevents the leads from crossing over each other and holds them at the proper level for loading into a connector block 16 having a single linear row of terminal receiving cavities. The leads may be terminated prior to loading into the clamps 11 or may be loaded into the clamps and terminated by separate apparatus at another conveyor stop prior to insertion into a connector block 16 at the instant apparatus 10. The instant invention is especially suitable for use with wire terminating apparatus of the type described in U.S. Pat. No. 4,363,167 where the terminating apparatus is located at an upstream conveyor stop. There the leads are spread and vertically compensated to maintain the ends in a linear array for termination to strip fed terminals. This accounts for the bends in the leads between the clamps 11 and the guide plates 13, 14.

Referring still to FIG. 1, connector housings or blocks 16 are delivered to the apparatus by a vertical feed magazine 15, then transported laterally by transfer arm 80 to insertion block carriage 90. The leads are meanwhile aligned into grooves in template 30 by wiper 40 and held firmly therein by containment plate 50, while upper comb 70 and lower comb 60 align the terminals. The connector block 16 is then delivered onto the terminals on the ends of the leads and transported from the apparatus 10 by the traveling wire clamp 11. Details of the above operations will now be described.

Figure 2A:
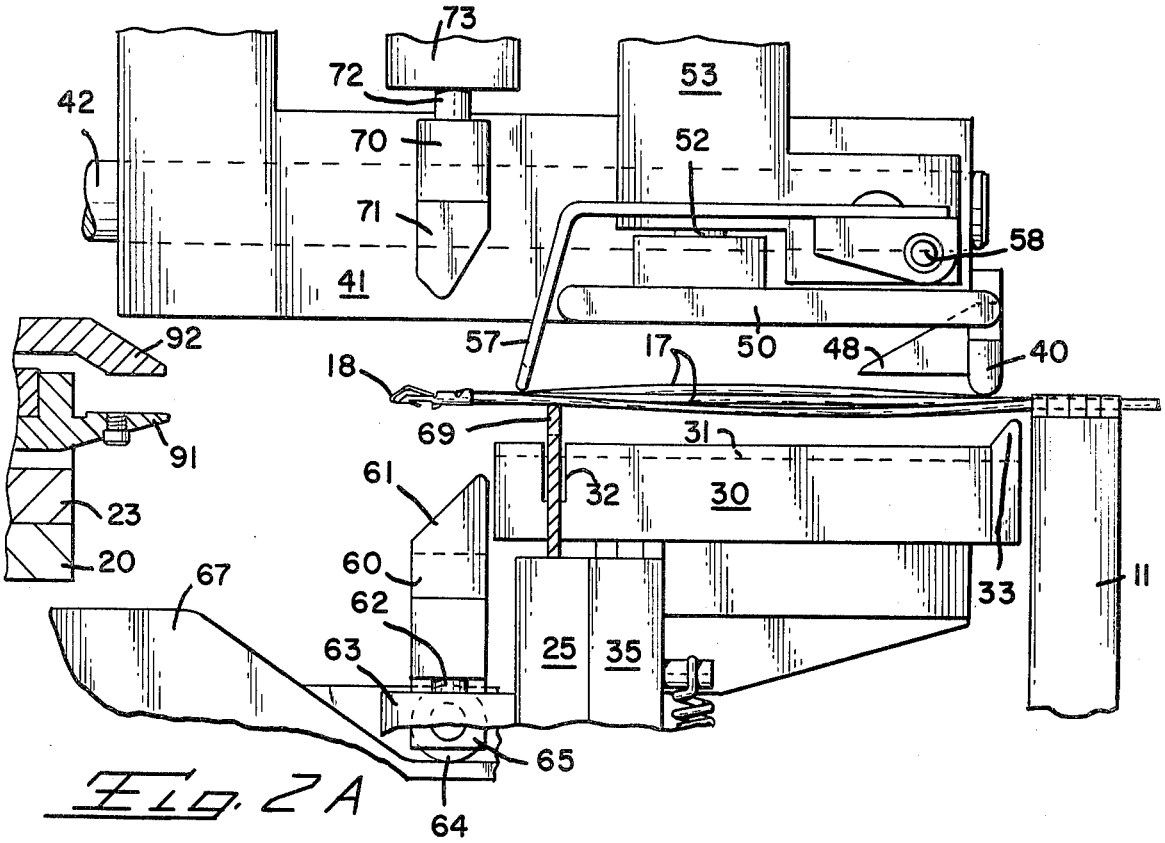
FIGS. 2A–2F are elevation views of the operating zone.

FIG. 2A et seq depict the operating sequence of the apparatus. The motions are effected by cams and linkage which will be discussed subsequent to these Figures. It may be helpful to refer to the timing diagram, FIG. 7, in conjunction with these figures.

FIG. 2A is an elevation of the operating zone immediately after the leads 17 are delivered thereto by clamp 11. The leads are trapped between wire hold down plate 57 and lower guide rail 69, which are contiguous with plates 13, 14 (FIG. 1) and likewise serve to prevent the leads from crossing over each other. Intermediate the terminals 18 and clamp 11, the leads lie between template 30 and containment plate 50. The template has parallel grooves 31 in the top face thereof and teeth 33 which define spaces therebetween contiguous with the grooves. The grooves extend from a first edge of the template proximate to clamp 11 to a second edge remote from the clamp. The teeth are each positioned immediately beneath a gap between the leads 17, which have a fixed spacing at the clamp 11. The leads pass immediately beneath wiper 40, a long member seen on end in this view which has a semi-cylindrical lower surface.

Figure 2B:
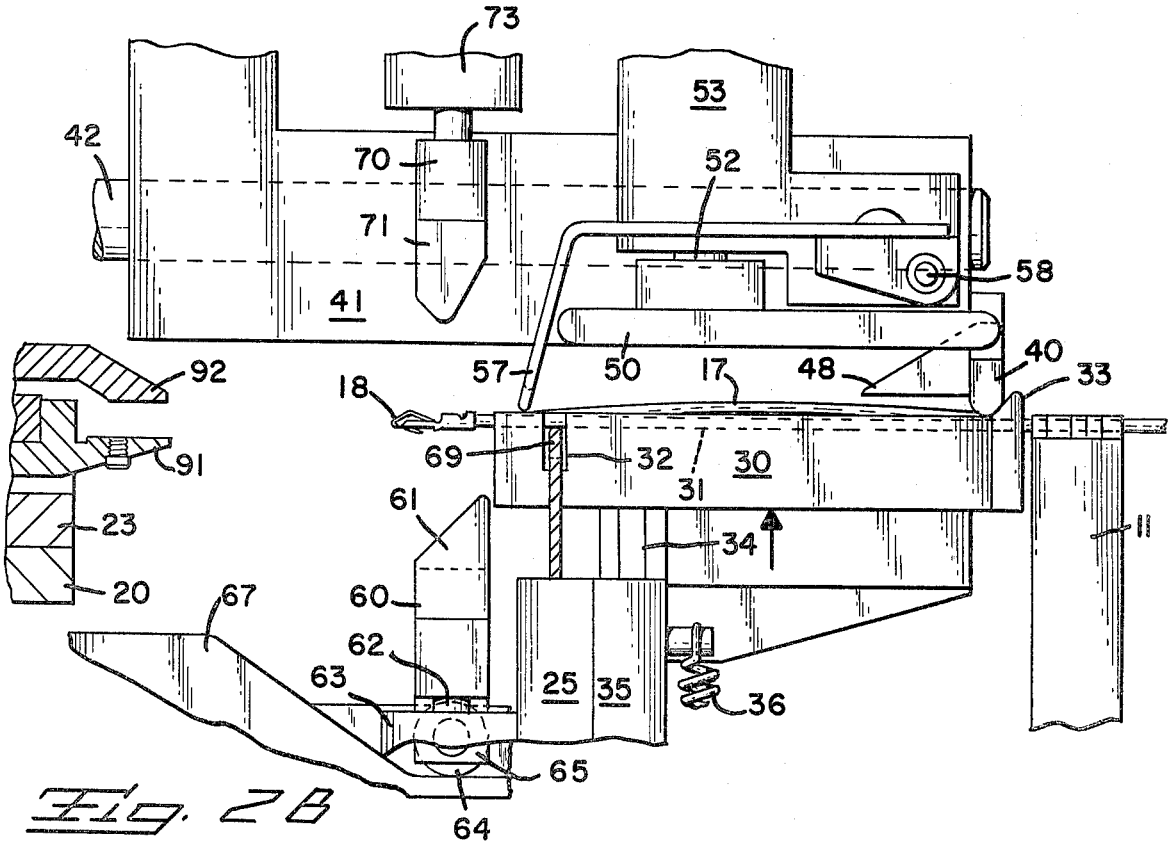

FIG. 2B shows the next step, which is the raising of the template 30 so that teeth 33 capture the leads 17 in the grooves 18 immediately beneath the wiper 40. The template 30 is raised upward on slide 34 which rides between gibs 35 attached to front frame member 25. Channel 32 in template 30 receives the top part of rail 39, which is cut away to receive the template.

Figure 2C:
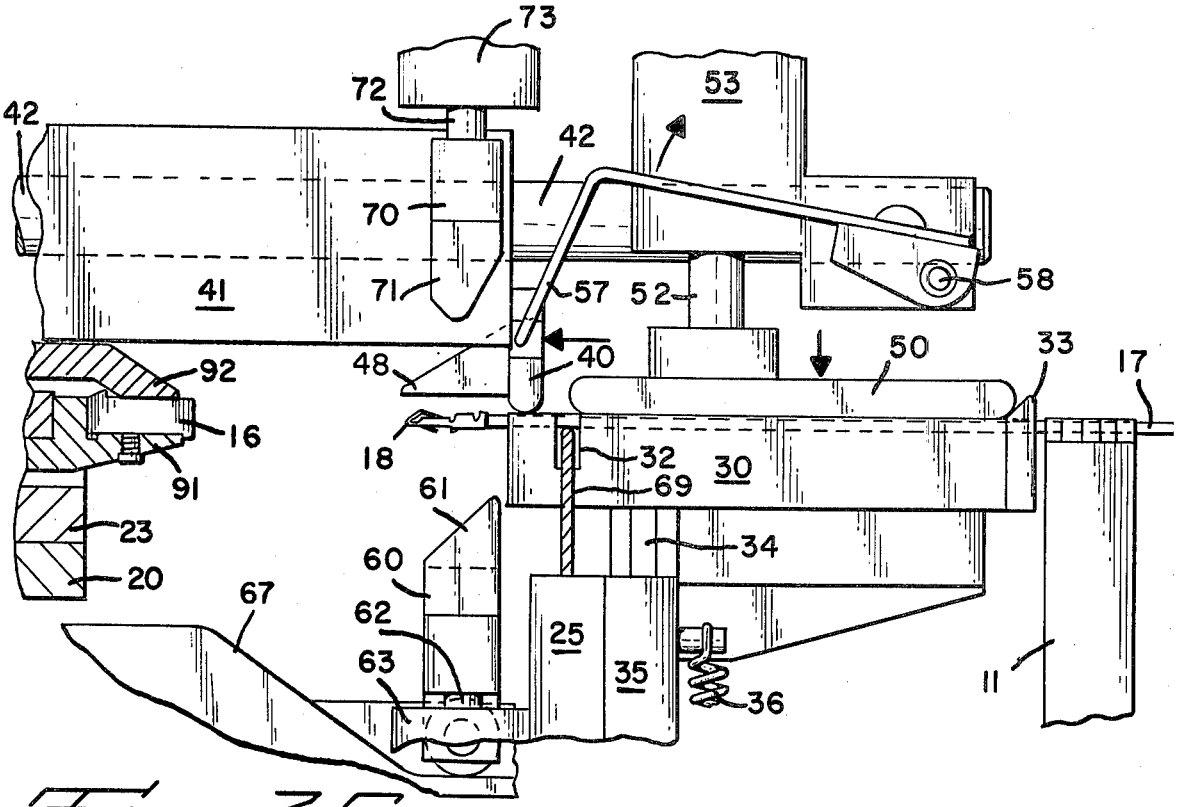

FIG. 2C depicts the completion of the next two steps: first, wiper 40 moves leftward to wipe the leads 17 into the parallel grooves 31 in the template 30; second, containment 50 drops to capture the leads 17 completely in grooves 31. Referring to the timing diagram (FIG. 7) this occurs at about 20° in the cycle. The wiper 40 is drawn leftward by wiper slide housing 41, which is journaled to shaft 42. The housing 41 also carries ramp 48 which pivots the hold down plate 57 upward; the hold down plate pivots about shaft 58 which is carried in containment slide housing 53. The containment plate 50 moves downwardly by the action of slides 52 which move through bores in slide housing 53. Note that a connector block 16 has meanwhile been delivered by connector advance means comprised of lid 92 and lower jaw 91 at the forward end of insertion block carriage 90 (FIGS. 2E and 2F).

Figure 2D:
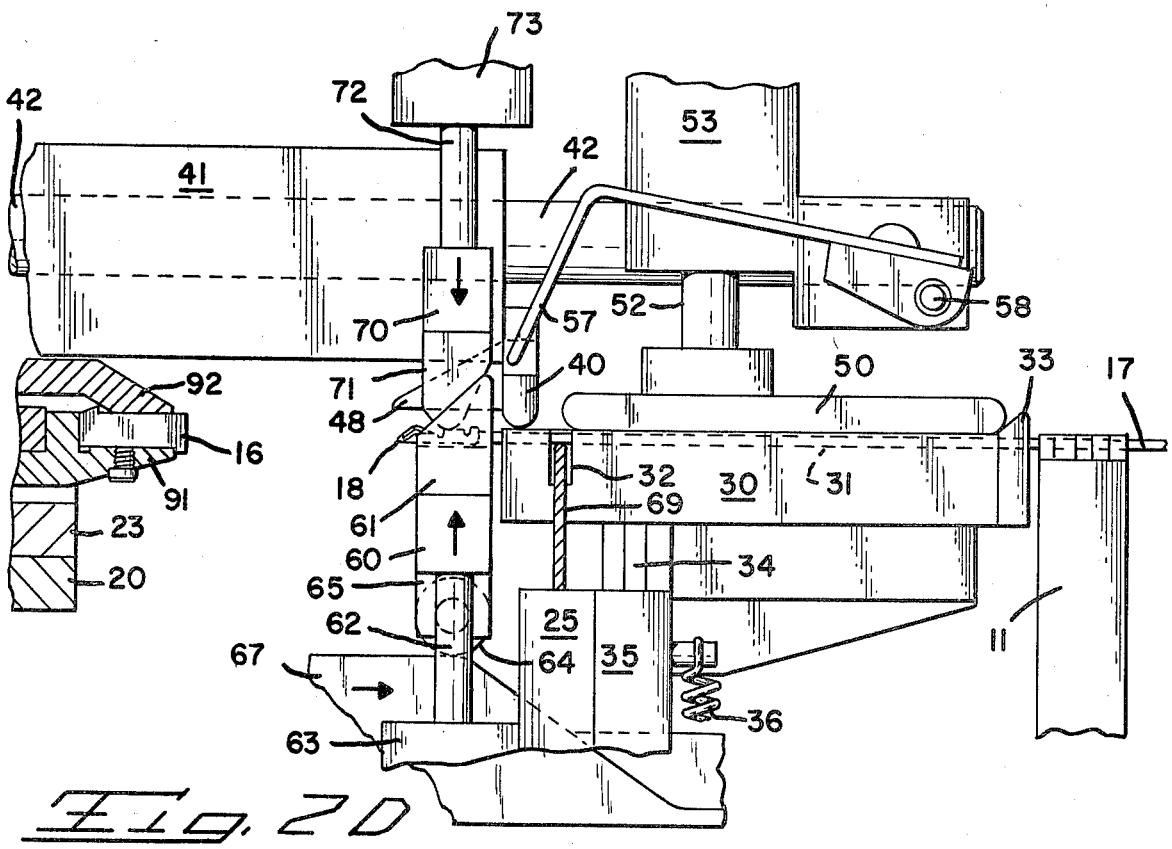

FIG. 2D shows the lower comb 60 and upper comb 70 as they mesh and capture the terminals 18 therebetween. The lower comb 60 has teeth 61 defining cradles therebetween which are contiguous with channels 31 in the template 30. The lower comb 60 is fully raised before the upper comb 70 completes its descent, aligning the terminals and nesting them between teeth 61. The teeth are chamfered on either side to provide lead-ins to the cradles which radially align the terminals 18 as the comb 60 moves upward. The lower comb rides upward on slides 62 which are carried in bores in slide housing 63. The comb 60 is driven upward by a follower 64 attached to a follower carriage 65 on the underside of the comb. The follower rides on a cam 30 as will be described in conjunction with FIGS. 3 and 5. The upper comb 70 has teeth 71 which enter the cradles between the teeth 61 on the lower comb 60 to capture the terminals 18 as shown. The upper comb is spring loaded downward on slides 72 which are carried in bores in slide housing 73. The fact that the comb is spring loaded rather than driven precludes the possibility of excess comb travel, which could damage a terminal.

Figure 2E:
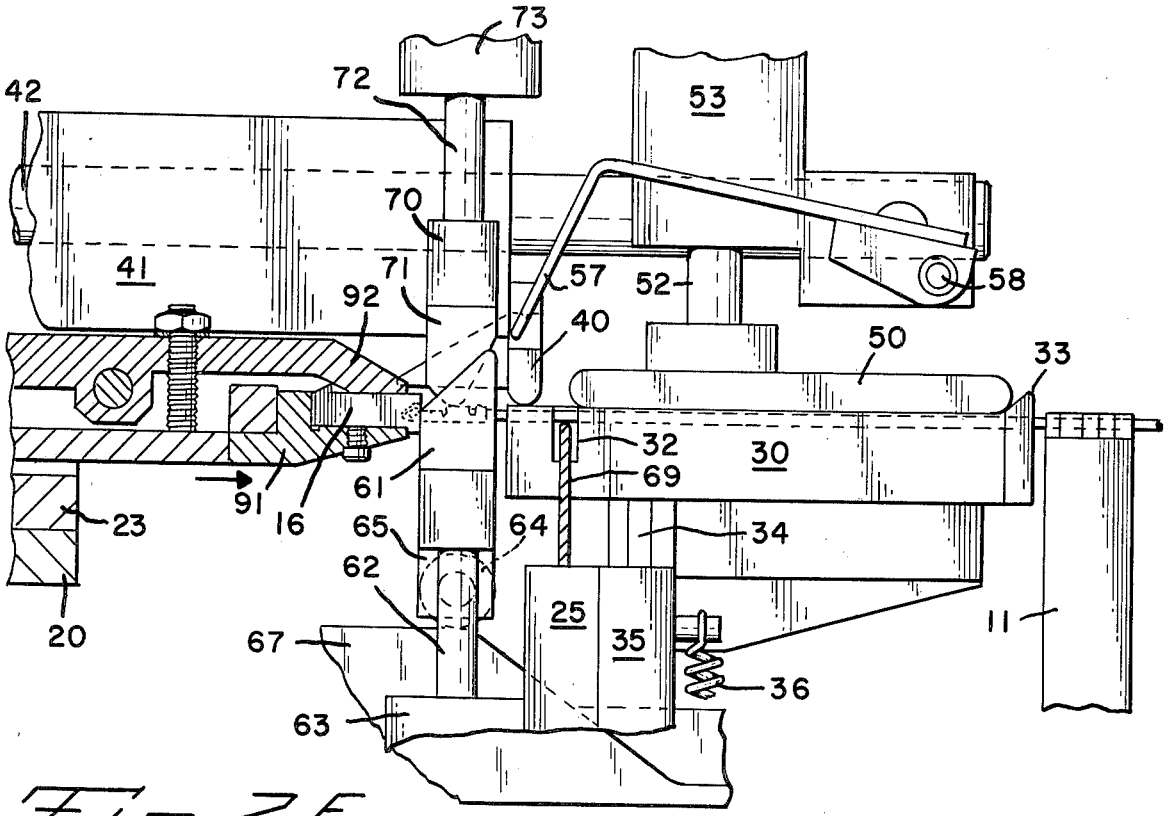

FIG. 2E shows the connector block 16 advanced onto the leading ends of terminals 18. The connector has cavities with a spacing corresponding to that of the cradles in the lower comb 60. The carriage 90 dwells at this point while the lower and upper combs 60, 70 recede, the terminals 18 being captured between the connector block 16 at one end and between the wiper 40 and template 30 proximate to the wire crimp portion of the terminal.

Figure 2F:
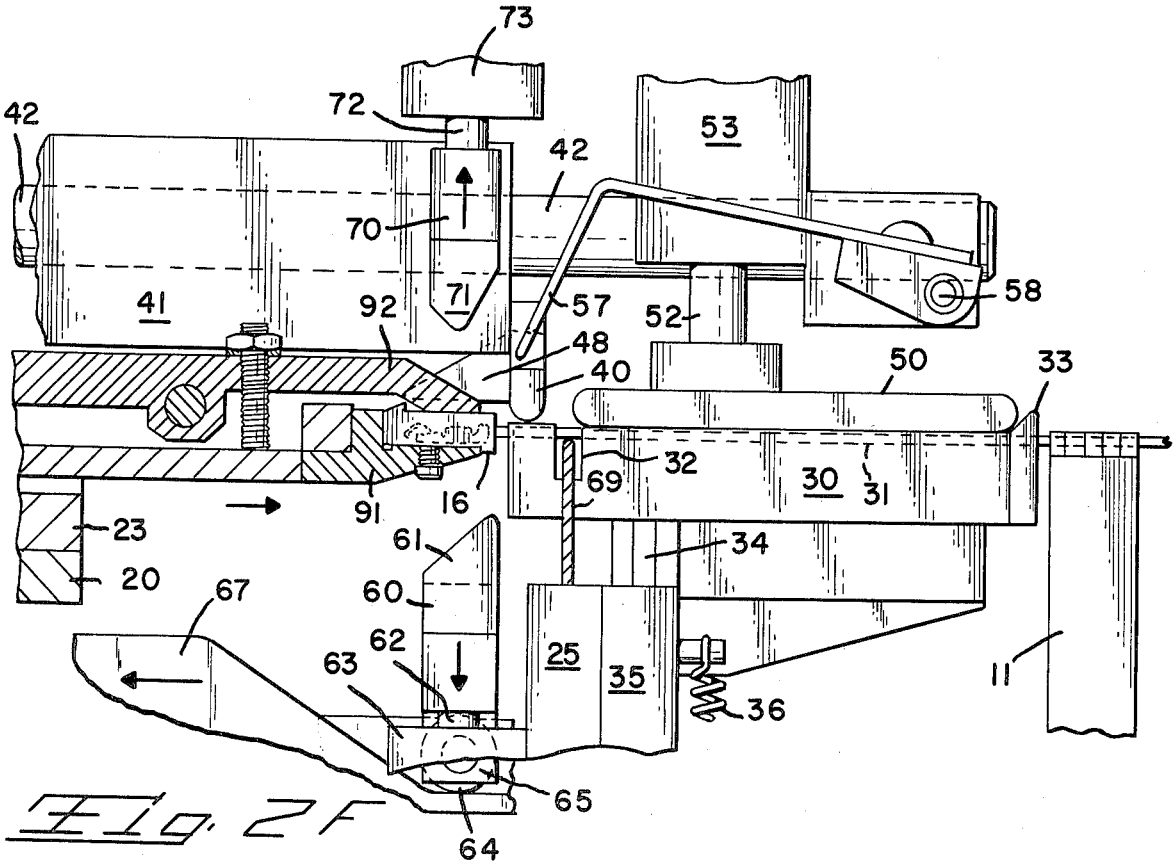

Referring to FIG. 2F, the insertion block carriage 90 continues to advance after the combs 60, 70 have receded until the terminals 18 are fully inserted in the connector block 16. Referring to the timing diagram (FIG. 7), this occurs at about 260° in the cycle. Subsequently, the insertion block carriage 90, template 30, and containment 50 will retreat and traveling wire clamp 11 will move the loaded leads from the apparatus while another clamp 11 takes its place in the position of FIG. 2A. Note that the terminals 18 each have a resilient lance which locks them into the connector block 16 while the carriage 19 retreats. Some resistance is met by the block 16 which would cause the leads to tend to buckle but for the containment 50 confining the leads in the grooves 31 in the surface of template 30.

FIGS. 3, 4, 5, and 6 are orthogonal views which detail the linkage used to effect the motions of FIG. 2A, et seq.

Figure 3:
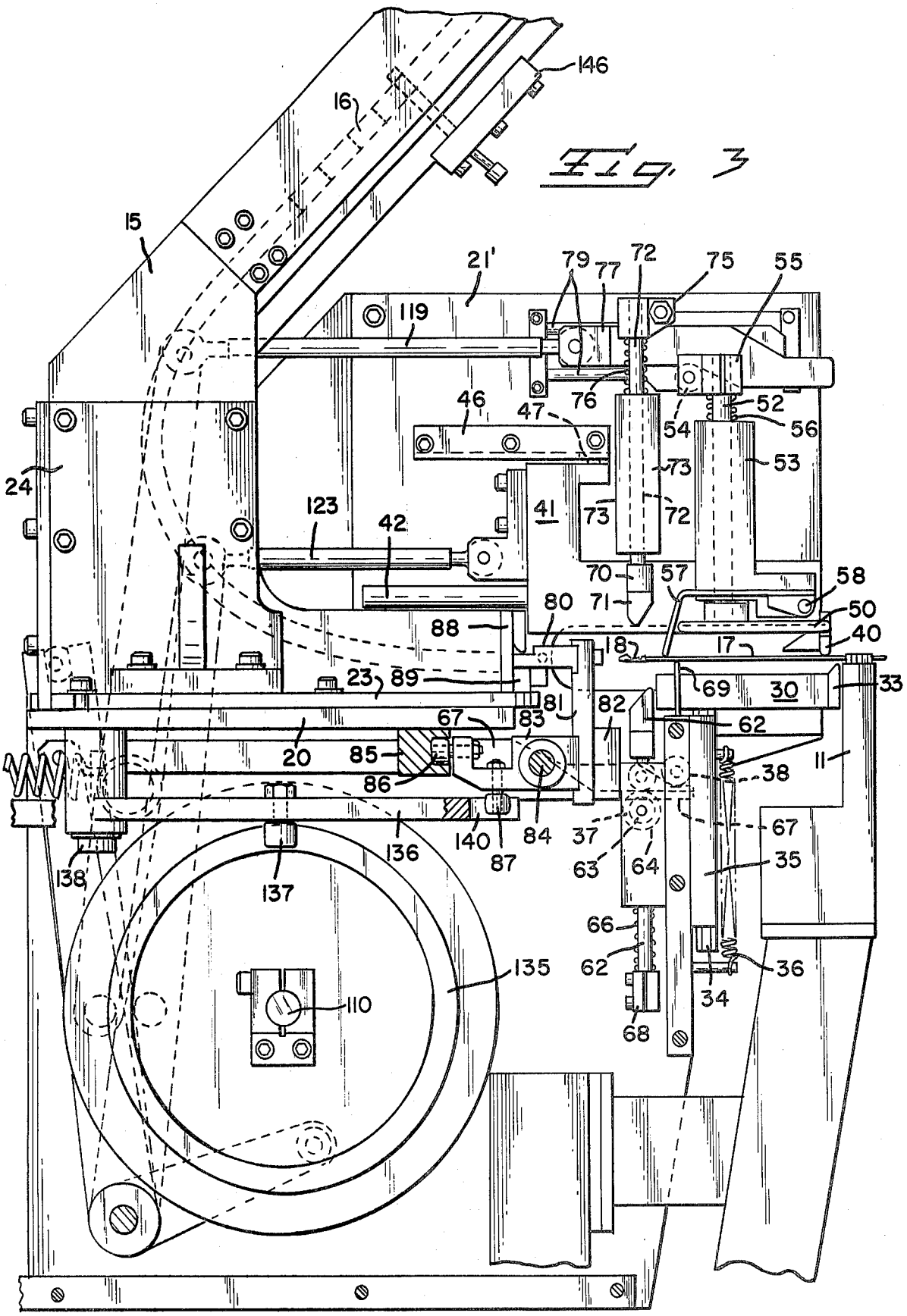
FIG. 3 is a left side elevation view of the apparatus.

FIG. 3 is an elevation view of the left side of the apparatus. The left side frame plate 22 (FIG. 1) has been deleted for clarity. The primary support members visible in this view are front plate 25 and table 20, to which mounting plate 23 is attached. Magazine mount 24 is fixed to mounting plate 23 and supports magazine 15 which feeds connector 16 by gravity to transfer arm 80. Loading weight 146 rides slideably against the column of connectors 16 and eventually hits a switch on the magazine (not shown) which detects low connector block level and can be arranged to shut down the apparatus until the magazine 15 is reloaded. Cam shaft 110 carries the cams (FIG. 6) which effect all mechanical movements of the apparatus. Block feed drive arm 136 is pivotably attached to frame 20 at pivot 138 and carries a follower 137 which rides on cam 135 to effect movement of the carriage 50. Spring 139 attached to spring mount 26 puts tension on a lever integral with drive arm 136 to hold the follower 137 against cam 135. The drive arm 136 has a clevis-like slot 140 in the end which acts on gudgeon 87 borne by shaft housing 83 which is slideably journaled to feed shaft 84. Transfer arm 80 is attached to mount 81 which in turn is bolted to housing 83 so that the transfer arm 80 reciprocates as cam 135 rotates. The motion of arm 80 is limited to one degree of freedom by stabilizer follower 86, which is carried by housing 83 and rides in stabilizer track 85, which is attached to the underside of frame table 20.

Referring still to FIG. 3, linear cam 67 reciprocates from left to right and imparts vertical movement to template 30 and lower comb 60. The cam 67 is a dual cam insofar as it has two sloped surfaces which act on template follower 38 and lower comb follower 64 respectively (see also FIG. 5). Template follower 38 is carried on the back of template slide 34 and moves upward through a window 39 in front plate 25 as the slide 34 slides through gibs 35. Tension springs 36 attached to the slide 34 and plate 25 assure positive return of the template 30. Lower comb follower 64 is carried under comb 60 and moves upward as slides 62 slide through bearings in comb slide housing 63. Return is effected by compression springs 66 between slide clamp 68 and the housing 63, which has bores therein to receive the springs 66. The cam 67 rides on a support idler 37 which is carried by slide housing 63.

Referring again to FIG. 3, linear cam 77 reciprocates from right to left and imparts vertical movement to containment 50 and upper comb 70. Cam 115 is also a dual cam insofar as it has two sloped surfaces which act on containment follower 54 and upper comb follower 75 respectively. Containment follower 54 is borne by follower carriage 55 which is clamped to the top of slides 52 which travel through containment slide housing 53. Compression spring 56 rests in a bore in the housing 53 and urges carriage 55 upward against the cam 77. Upper comb follower 75 is borne by follower carriage 74 which is clamped to the top of slides 72 which travel through upper comb slide housing 73. Tension springs 76 attached to the carriage 74 and in the housing 73 urge it downard as the cam 77 travels to the left. The cam 77 is attached to a carriage 78 (FIGS. 4 and 6) which rides on guide shafts 79 which are mounted to right side of plate 21'.

Figure 4:
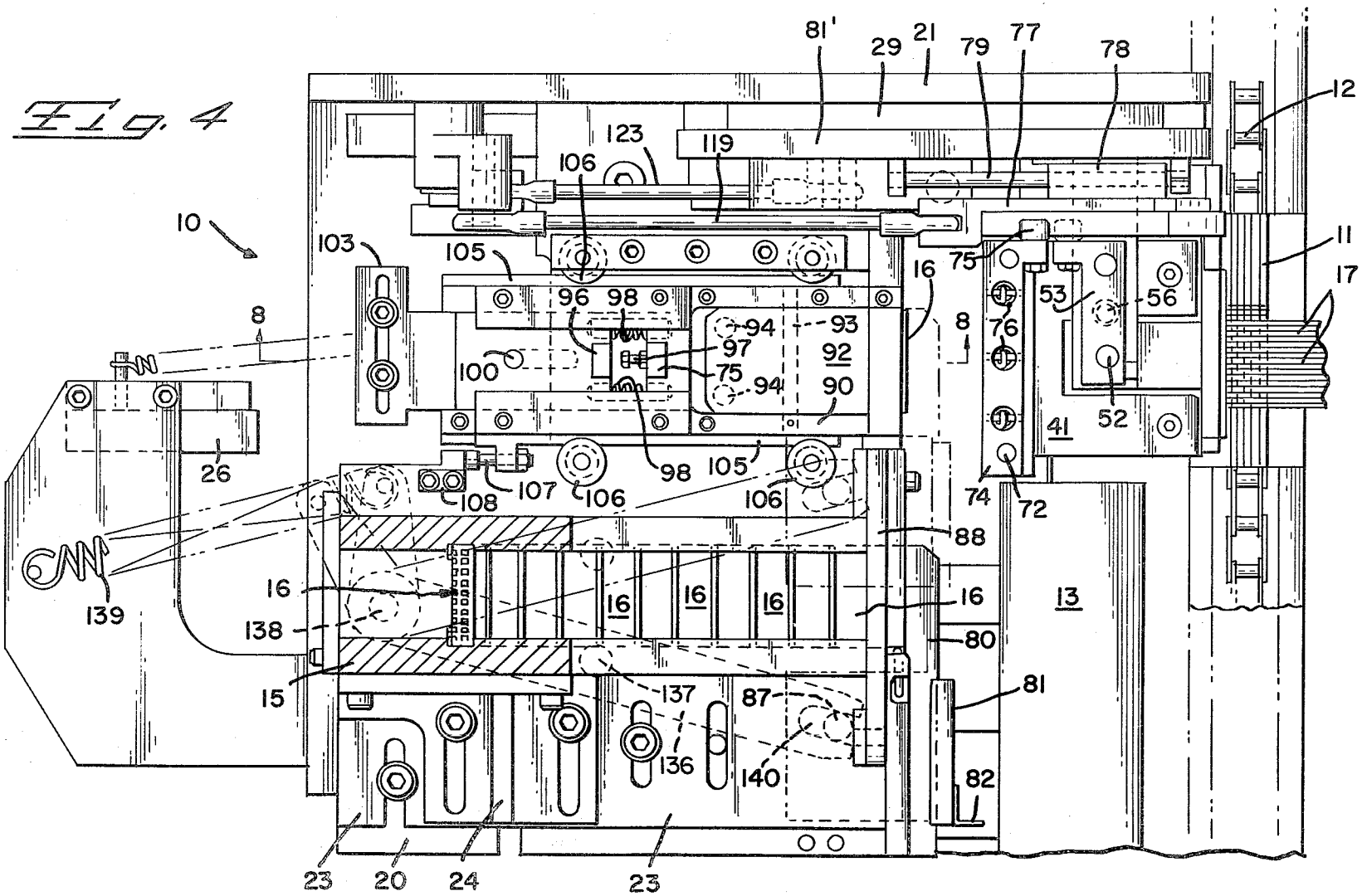
FIG. 4 is a plan view of the apparatus.
Figure 6:
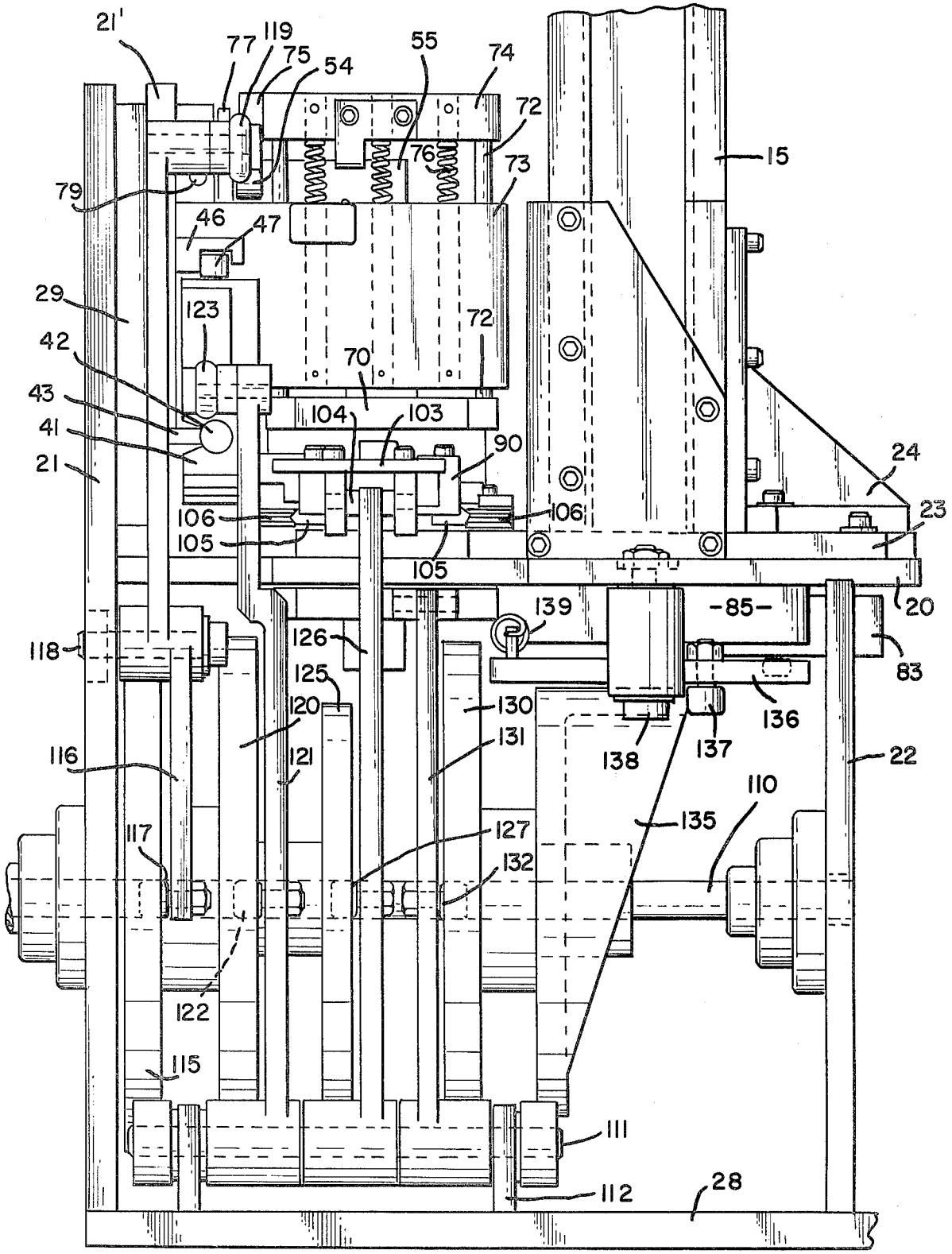
FIG. 6 is a rear elevation of the apparatus.

FIG. 4 depicts the apparatus in plan and shows the block feed drive arm 136 and tension spring 139 most clearly. Connector block 16 is fed toward transfer arm 80 then transported through upper and lower block guides 88, 89 (FIG. 3) to position in insertion carriage 90 as shown in phantom. Lid 92 is carried in the carriage by pivot shaft 93 and is loaded toward the connector 16 by springs 94. The carriage 90 has V-rails 105 fixed thereto which ride in V-wheels 106, which are mounted on mounting plate 23 (FIG. 6). The carriage 90 is driven forward by drive block 99 which is mounted slideably in the carriage 90 by retaining plates 102. Pin 100 is fixed to the block 99 and slides in slot 101 in the carriage against the action of springs 98 to urge the connector 16 against the combs 60, 70 in the position of FIG. 2E. The return travel of the carriage 90 is limited by stop screw 107 bearing against stop 108 which is fixed to the mounting plate 23.

Figure 8:
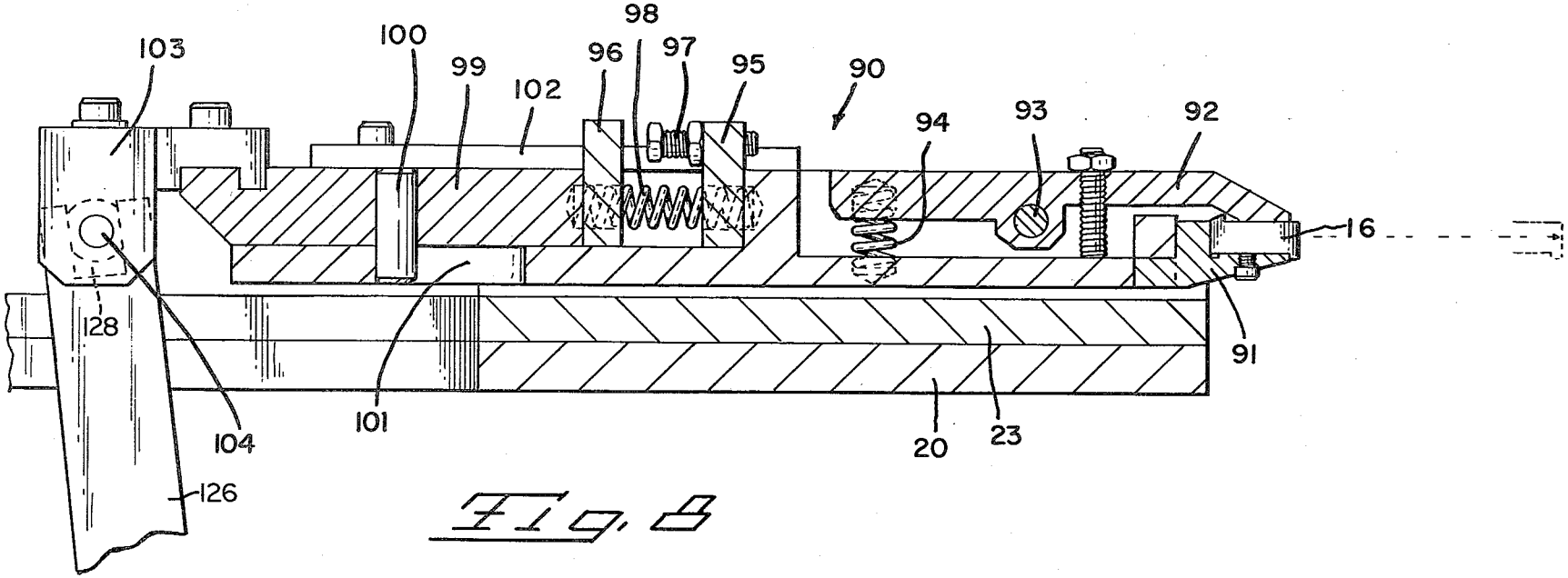
FIG. 8 is a cross section of the insertion carriage.

Digressing briefly to FIG. 8, the insertion carriage 90 is shown in cross-section. Lower jaw 91 and lid 92 may be changed to accommodate connector blocks having a different profile. The drive block 99 has a gudgeon mount 103 fixed thereto carrying a gudgeon 104 which rides in a clevis-like slot 128 in lever arm 126 to impart reciprocating motion to the carriage 90.

Returning to FIG. 4, the linear cam 77 is drawn to the left by connecting rod 119 to lower the containment 50 and upper comb 70. The wiper slide housing 41 is down to the left by wiper connecting rod 123.

Figure 5:
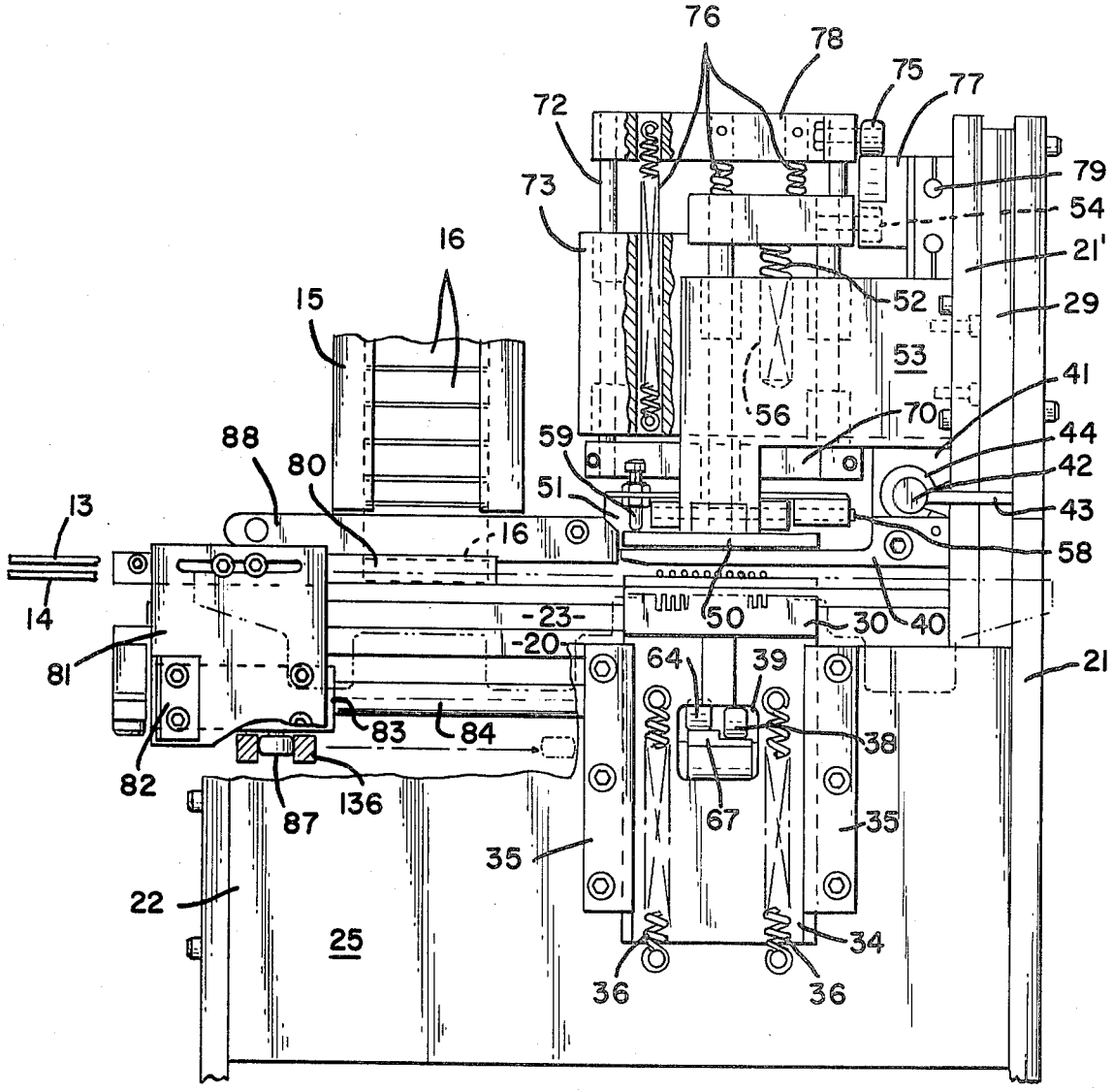
FIG. 5 is a front elevation of the apparatus.
Figure 7:
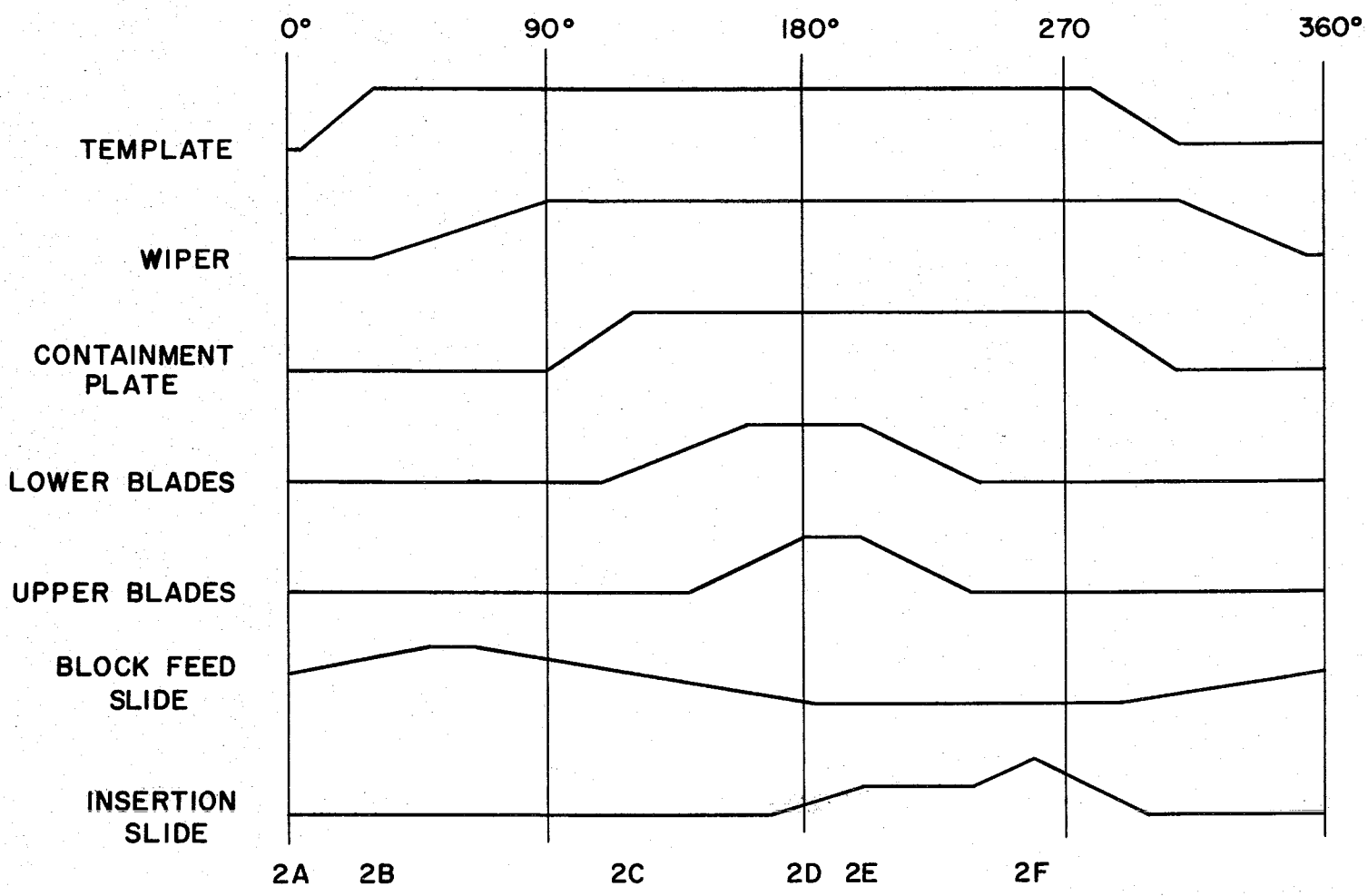
FIG. 7 is a timing diagram.

FIG. 5 is a front elevation showing the apparatus in the position of FIG. 2A. Transfer arm 80 is adjustably fixed to mount 81 which also carries actuator 82, a simple plate positioned to activate a switch (not shown) on the return of the transfer arm 80, about 190° in the cycle (FIG. 7). This is the third of three mechanically actuated switches (not shown) which signal a controller on the successful completion of various stages in the cycle of the apparatus. The first is actuated by plate 82 at the end of the advance stroke of the transfer arm 80, about 50° into the cycle (FIG. 7). This tells the controller that one and only one block 16 has entered the carriage 90. The second switch is mounted on slide housing 73 (FIG. 6) and is actuated by the full descent of upper comb 70, about 180° into the cycle. If all three switches are not actuated, the cam shaft 110 is reversed and the cycle to this point is repeated from 0° while the transfer arm 80 is held in place. This is possible since the transfer arm 80 is spring loaded forward, the advance stroke being effected by a follower 137 riding against open faced cam 135. The transfer arm 80 is held in place by a lock out latch mounted to the frame, which loads a solenoid actuated blade (not shown) into a slot in the housing 83 (FIG. 3). The slot is wide enough to allow the actuator 82 to ride away from the third switch while the cycle is repeated. The conveyor, meanwhile, carries a new set of leads into the apparatus. If all three switches are not actuated after two recycles, the controller is programmed to shut down the conveyor as well as the rest of the apparatus.

Referring still to FIG. 5, the mount 81 is carried on shaft housing 83 which rides on block feed shaft 84 as the drive arm 136 reciprocates. The linear cam 67 is shown as it appears through window 39 in template slide 34. The window 39 permits passage of the cam 67 on its forward stroke as it drives followers 34 and 64 upward with the template 30 and lower comb 60 respectively. The wiper 40 is borne by wiper slide housing 41 which carries a linear bearing 44 so it slides readily on wiper shaft 42 to draw the wiper 40 over template 30. The wiper shaft 42 is fixed to right side plate 21 by shaft mount 43. Right side plate 21 is a primary structural member; right side inner plate 21' provides a mounting surface which is fixed to plate 21 with spacer 29 therebetween. The containment slide housing 53, upper comb slide housing 73, and cam guide shafts 79 are fixed to inner plate 21'. Linear cam 77 moves away to cause follower 54 to ride down the lower cam surface which lowers containment 50, then follower 75 rides down the upper surface of cam 77 to lower the upper comb 70.

FIG. 6 is a rear elevation view of the apparatus detailing the cams and levers which drive the mechanical components described above. Cam shaft 110 is carried by right side plate 21 and left side plate 22 and has cams 115, 120, 125, 130, and 135 fixed thereto by hubs. A lever pivot shaft 111 has levers 121, 126, 131 journaled thereto and is carried by mounts 112 which are fixed to base 28. Lever 116 is journaled to pivot 118 which is fixed in right side plate 21; lever 116 has a follower 117 at its lower end which rides in a slot in cam 115 causing connecting rod 119 at the upper end of lever 116 to reciprocate. Connecting rod 119 is attached to linear cam 77, so the rotation of cam 115 effects the vertical movement of the containment 50 and upper comb 70.

Lever 121 carries a follower 122 above pivot shaft 111 which rides in a slot in cam 120 causing connecting rod 123 at the upper end of lever 121 to reciprocate. Connecting rod 123 is attached to wiper slide housing 41, so the rotation of cam 120 effects the horizontal movement of wiper 40. The forward travel of wiper slide housing 41 is stabilized by wiper stabilizer follower 47 riding through stabilizer track 46, which is fixed to right side inner plate 21'. Lever 126 carries a follower 127 above pivot shaft 111 which rides in a slot in cam 125 causing the upper end of lever 126 to reciprocate, so the rotation of cam 125 effects the horizontal movement of insertion carriage 90. Lever 131 carries a follower 132 above pivot shaft 111 which rides in a slot in cam 130 causing connecting rod 133 at the upper end of lever 131 to reciprocate. Connecting rod 133 is attached to linear cam 67, so the rotation of cam 130 effects the vertical movement of the template 30 and lower comb 60.

Referring still to FIG. 6, lever 136 is journaled to pivot 138 which is fixed to frame table 20; lever 136 has a follower 137 midway between the pivot 138 and transfer arm slide housing 83 (FIG. 3). The follower 137 rides on a volute surface of cam 135 to impart horizontal movement to the transfer arm slide housing 83, which is urged toward the insertion carriage 90 by tension spring 139.

In the preferred embodiment described above, the template 30 has parallel grooves. This assumes that the cavities in the connector housing are spaced the same distance apart as the leads in the clamp. If, however, it is desired to load terminals into cavities having a greater spacing than the leads in the clamp, a template having diverging grooves could be employed. As this could lead to a non-linear array of terminals at the second edge of the template, the innermost grooves follow a squiggly path between the opposite edges of the template while the outermost grooves diverge more smoothly. Thus, paths of the grooves may be profiled in the template so that the terminals remain in a linear array at the combs while the leads diverge, the axial distance between the clamping point of each lead and the respective terminal being the same while the linear distance varies.

The above description is examplary and is not intended to limit the scope of the claims which follow.

What is claimed is:

1. Apparatus for positioning terminals on the ends of a plurality of leads in a connector housing having a linear row of terminal receiving cavities at a fixed spacing comprises:

holding means for holding said leads at said fixed spacing proximate to said terminals, said holding means comprising gripping means which grip said leads to prevent axial movement of said leads, said leads being gripped along a straight line perpendicular to the axes of the leads, aligning means adjacent to said holding means, said aligning means comprising first and second comb members, said first comb member having teeth defining cradles therebetween having said fixed spacing of said cavities, said cradles being profiled to receive said terminals, said second comb member having teeth profiled to enter said cradles and bear against said terminals, said combs being arranged to move toward each other so that their respective teeth intermesh, said combs moving generally perpendicular to the axes of the leads, connector advance means for releasably gripping a connector with said cavities facing said holding means and advancing said connector toward said holding means, whereby, upon holding said leads in said holding means with said terminals spaced from said gripping means, and upon moving said combs so that said teeth intermesh with said teeth of said second comb bearing against said terminals in said cradles and said terminals extending slightly beyond said combs, and upon advancing a connector so that the terminals partially enter the cavities, said combs are retracted and said connector is further advanced toward said holding means until said terminals are fully inserted in said cavities in said connector.

2. The apparatus of claim 1 wherein said holding means further comprises containing means extending between said gripping means and said aligning means, said containing means comprising a generally planar template having a like plurality of lead receiving grooves therein extending between a first edge adjacent to said gripping means and a second edge adjacent to said aligning means, said grooves being spaced at said first edge to receive leads gripped in said gripping means and spaced at said second edge to position said leads in said cradles, said containing means further comprising a containment plate, said template and containment plate being movable relatively together to capture said leads in said grooves, whereby said leads are restrained from axial movement as said connector is advanced onto said terminals.

3. The apparatus of claim 2 wherein said template has a plurality of raised teeth between said grooves at said first edge of said template, said template being movable so that said raised teeth pass between said leads adjacent to said gripping means and receive said leads in said grooves at said first edge, said apparatus further comprising a wiper arranged to move across said template from said raised teeth to said second edge after said template is moved to align said leads into said grooves at said first edge, whereby said wiper fully aligns said leads into said grooves, said containment plate thereafter moving against said template to capture said leads in said grooves.

* * * * *